United States Patent [19]

Chen

[11] Patent Number: 5,031,765

[45] Date of Patent: Jul. 16, 1991

[54] PROTECTIVE CASING FOR NAIL SCISSORS

[76] Inventor: Shih-Fang Chen, No. 513, Pwu Tzu St., Feng Yuan City, Taichung Hsien, Taiwan

[21] Appl. No.: 583,825

[22] Filed: Sep. 17, 1990

[51] Int. Cl.[5] ..... B65D 85/00; A45D 29/02

[52] U.S. Cl. ..... 206/234; 30/28; 132/73.5; 206/349

[58] Field of Search ..... 30/26, 28, 29; 132/73, 132/73.5; 206/37, 38, 45.14, 234, 235, 349, 363, 438, 570, 581, 823

[56] References Cited

U.S. PATENT DOCUMENTS

| | | | |
|---|---|---|---|
| 3,855,698 | 12/1974 | Crosby | 30/28 |
| 3,903,596 | 9/1975 | Crosby | 30/29 |
| 3,943,948 | 3/1976 | Sartore | 30/28 |
| 3,997,966 | 12/1976 | Sartore | 30/28 |
| 4,176,449 | 12/1979 | Lee et al. | 30/28 |
| 4,341,015 | 7/1982 | Young | 30/28 |
| 4,550,496 | 11/1985 | Reinicke | 30/28 |
| 4,602,430 | 7/1986 | Allen, Jr. | 30/28 |
| 4,640,011 | 2/1987 | Gamble | 132/73.5 |
| 4,776,090 | 10/1988 | Grassi | 132/73 |

FOREIGN PATENT DOCUMENTS

| | | | |
|---|---|---|---|
| 2153220 | 8/1985 | United Kingdom | 132/73 |

*Primary Examiner*—Jimmy G. Foster

*Attorney, Agent, or Firm*—Fitch, Even, Tabin & Flannery

[57] ABSTRACT

A protective casing includes a body which has a front end opened. A base has a stub passing through a hole of a pair of nail scissors and is receivable in the lower portion of the body and so that the nail scissors can be retained in the body. A cap is provided for enclosing the lower portion of the body. A lateral portion of the nail scissors is enclosed and fenced by a lid so that the nails cut by the nail scissors are prevented from discharging out of the lid and so that the nails can be directly collected in the body.

3 Claims, 5 Drawing Sheets

PROTECTIVE CASING FOR NAIL SCISSORS

BACKGROUND OF THE INVENTION

The present invention relates to a protective casing, and more particularly to a protective casing for a pair of nail scissors.

A pair of conventional nail scissors 3 are shown in FIG. 6. Generally, a hole 30 is formed in a rear end of the nail scissors. While cutting nails, the nails cut by the nail scissors 3 will discharge and disperse everywhere. It is usually required to find and to collect the cut nails manually so that the cut nails can be thrown away. This wastes time.

The present invention has arisen to mitigate and/or obviate the afore-described disadvantages of the conventional nail scissors.

SUMMARY OF THE INVENTION

The primary objective of the present invention is to provide a protective casing for a pair of nail scissors which directly collects the nails during cutting nails.

In accordance with one aspect of the invention, there is provided a protective casing which includes a body which has a front end opened. A pair of apertures are formed in a lower portion of the body. A base has a stub and a projection formed on the front surface and the rear surface. The stub passes through the hole of a pair of nail scissors and engages with one of the apertures of the body, and the projection engages with the other aperture so that the base is received in the lower portion of the body and so that the nail scissors can be retained in the body. A cap is force-fitted onto the lower portion of the body and is provided for enclosing the lower portion of the body. A lid is engagable on the upper end of the body. A lateral portion of the nail scissors is enclosed and fenced by the lid so that the nails cut by the nail scissors are prevented from discharging out of the lid and so that the nails can be directly collected in the body.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
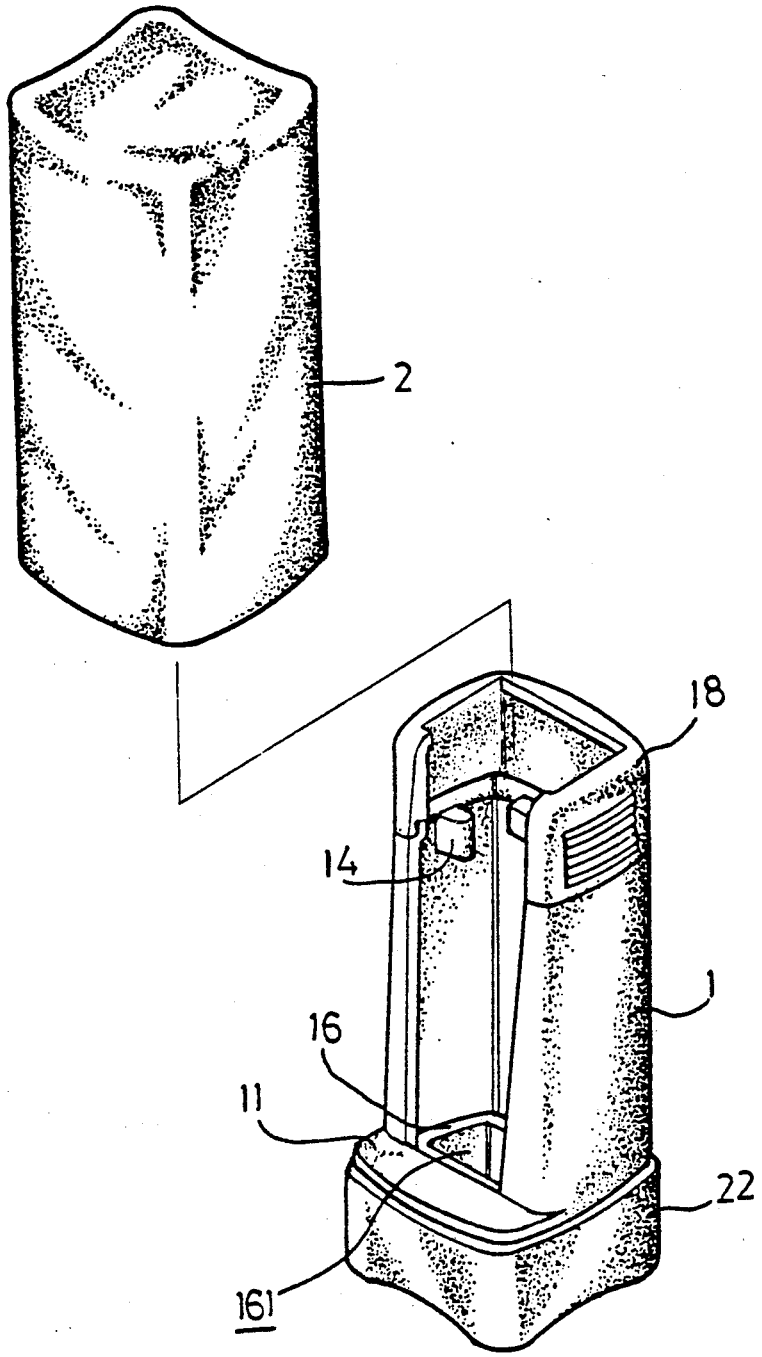
FIG. 1 is a perspective view of a protective casing in accordance with the present invention, in which a cover is shown separately.
Figure 2:
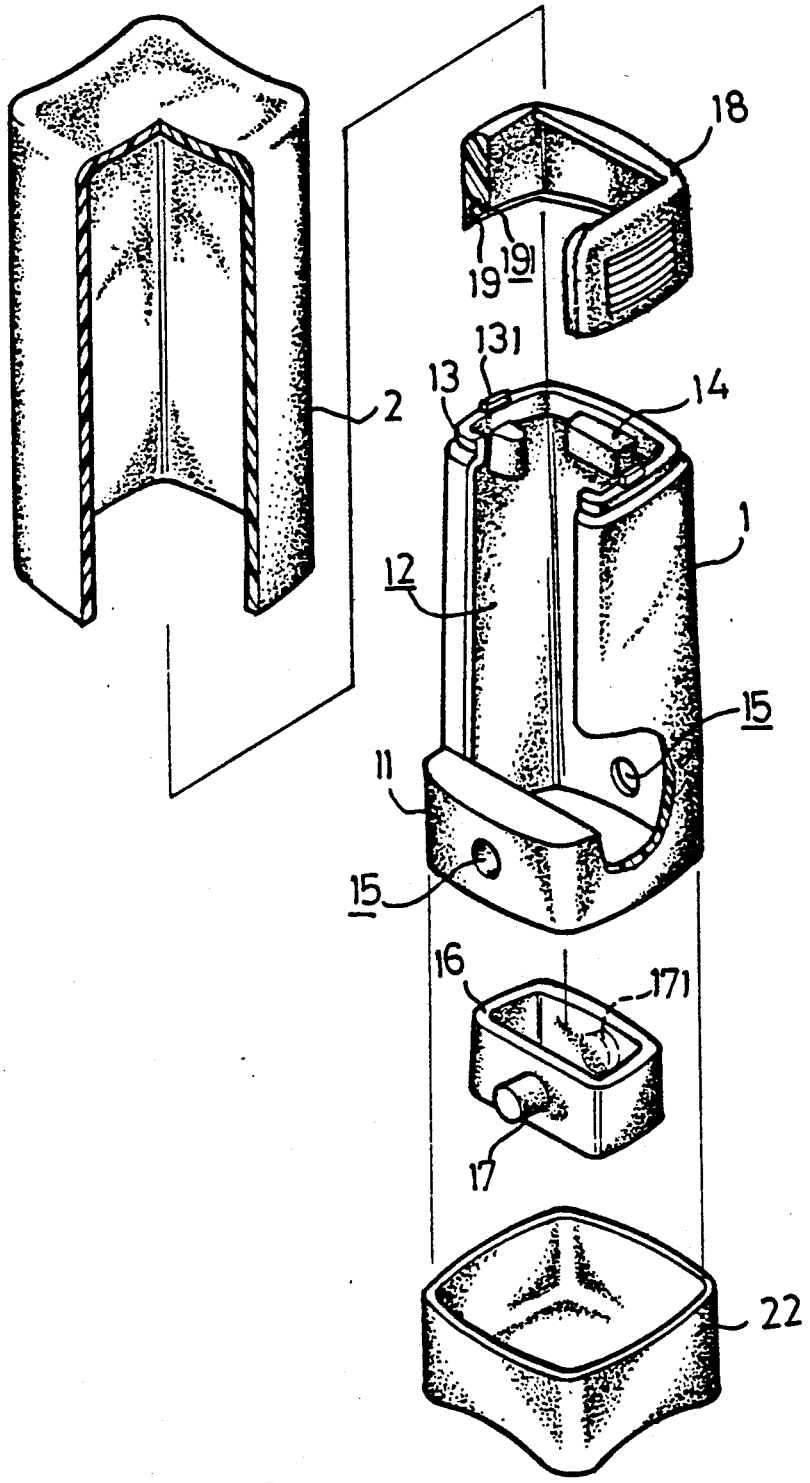
FIG. 2 is an exploded view of the protective casing of FIG. 1.

Referring to the drawings and initially to FIGS. 1 and 2, a protective casing for a pair of nail scissors in accordance with the present invention comprises generally a body 1, a base 16 engagable in the lower portion 11 of the body 1, a lid 18 engagable on the upper end of the body 1, a cap 22 provided for enclosing the lower portion of the body 1, and a cover 2 provided for enclosing the upper portion of the body 1. The protective casing in accordance with the present invention is preferably made of plastic materials or the like.

The body 1 is substantially rectangular parallelepiped having a lower portion 11 of larger size and having an opening 12 formed in the front surface thereof. Both the upper end and the lower end of the body 1 are opened. A shoulder 13 is formed on the perimeter of the upper end of the body 1. A pair of ears 131 are integrally formed on the opposite side of the upper end of the body 1 and extend upward. Three protrusions 14 are formed on the upper end portion of the inner surfaces of the rear wall and the side walls of the body 1 respectively. Two apertures 15 are oppositely formed on the front wall and the rear wall of the lower portion 11 of the body 1.

The base 16 is rectangular and is receivable in the lower portion 11 of the body 1. A stub 17 and a projection 171 are formed on the front surface and the rear surface of the base 16 respectively. The stub 17 and the projection 171 are engagable in the respective apertures 15 of the body 1, best shown in FIG. 4, so that the base 16 can be received in the lower portion 11 of the body 1. The cap 22 is arranged so that it can be force-fitted onto the lower portion 11 of the body 1, and so that the lower end of the body 1 can be enclosed by the cap 22.

The lid 18 has a shape corresponding to the upper end portion of the body 1. The lid 18 has an open upper end, an open lower end and an open front end. A shoulder 19 is formed in the perimeter of the lower end of the lid 18 and is engagable with the shoulder 13 of the body 1 by such as force-fitted engagement. A recess 191 is formed in each side wall of the lid 18 and engagable with the respective ear 131 of the body 1 by such as force-fitted engagement. The lower end of the cover 2 is provided for enclosing the upper portion of the body 1 and is arranged such that it can be force-fitted onto the upper edge of the lower portion 11 of the body 1.

Figure 3:
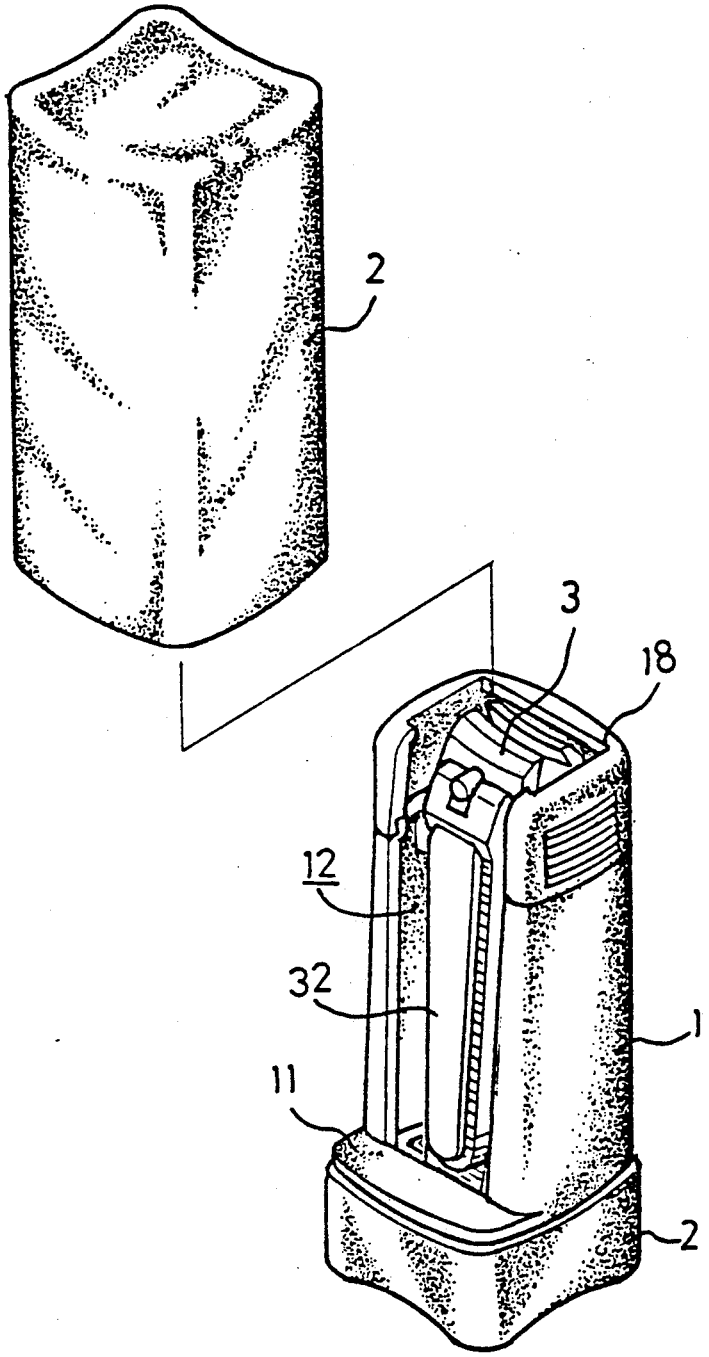
FIG. 3 is a perspective view of the protective casing, in which a pair of nail scissors are received in the body of the protective casing.
Figure 4:
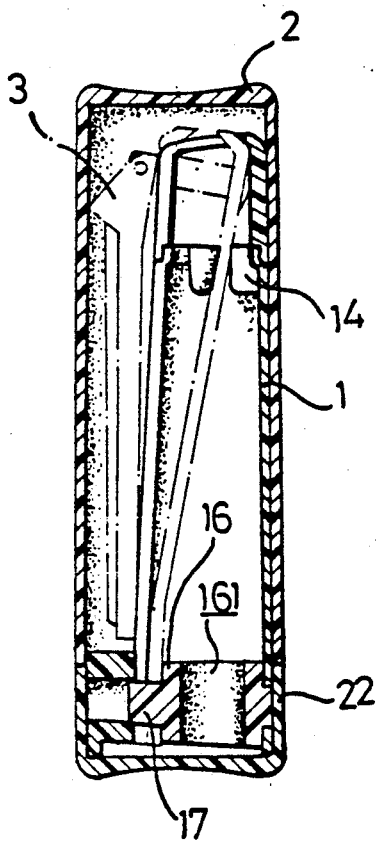
FIG. 4 is a cross sectional view of the protective casing.

Referring next to FIGS. 3 and 4, the stub 17 of the base 16 passes through the hole 30 (FIG. 6) of the nail scissors 3 before it is engaged within one of the apertures 15 so that the nail scissors 3 can be retained within the body 1. The upper portion of the nail scissors 3 is received among the three protrusions 14. The lateral portions of the nail scissors 3 are substantially enclosed and fenced by the lid 18. The lever arm 32 of the nail scissors 3 is reachable through the opening 12 of the body 1 and can be rotated for 180 degrees (FIG. 5) for operation purposes. The lateral portions of the nail scissors 3 are generally the place where the cut nails discharge and disperse. In the embodiment, the lateral portions of the nail scissors 3 are enclosed and fenced by the lid 18 so that the cut nails can be collected in the body 1.

Figure 5:
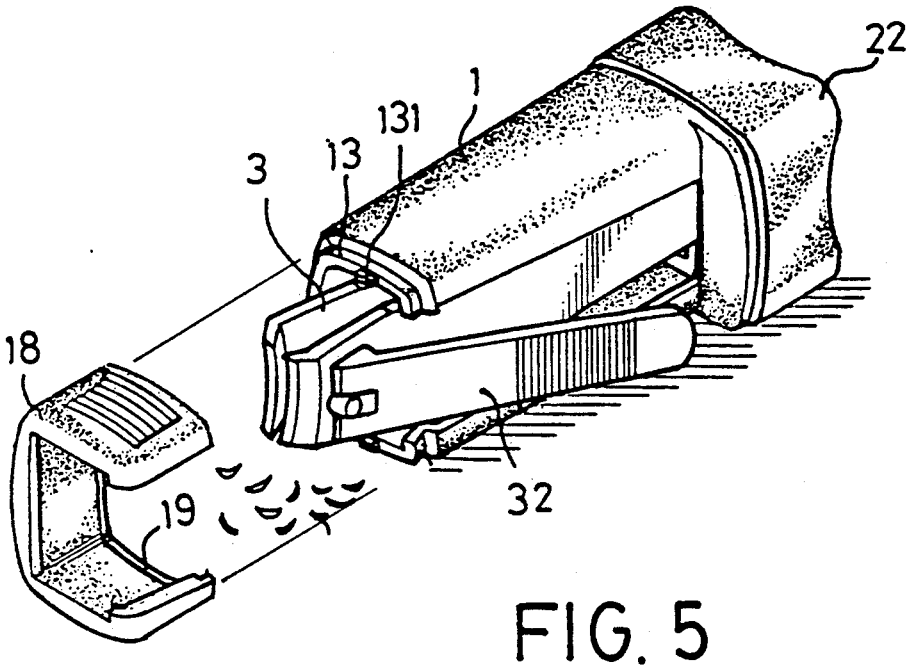
FIG. 5 is a partial perspective view of the protective casing, in which a lid is removed for throwing away the cut nails.
Figure 6:
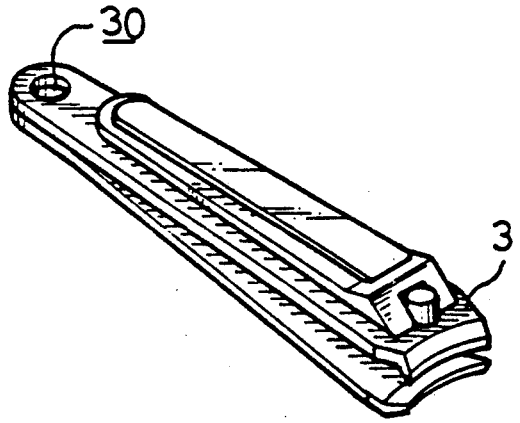
FIG. 6 is a perspective view of a pair of nail scissors.

Referring next to FIG. 5, when the lid 18 is removed from the body 1, the cut nails which are directly collected in the body 1 can be thrown away. There is no need to find and to collect the cut nails which is required when a conventional pair of nail scissors are used.

Accordingly, the protective casing in accordance with the present invention has the advantage to collect the cut nails directly and automatically so that there is no need to find and to collect the cut nails manually.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A protective casing for nail scissors, each of said nail scissors having a hole formed in a rear end thereof; said protective casing comprising a body which has an opening formed in a front end thereof, a first shoulder formed in a perimeter of an upper end of said body, a pair of apertures being oppositely formed in a lower portion of said body; a base having a stub and a projection respectively formed on the front surface and the rear surface thereof, said stub passing through said hole of said nail scissors and engaging with one of said apertures of said body, and said projection engaging with the other aperture so that the base is received in said lower portion of said body and so that said nail scissors can be retained in said body; a cap being force-fitted onto said lower portion of said body and being provided for enclosing said lower portion of said body; a lid having a second shoulder formed in a perimeter of a lower end thereof, said second shoulder being engagable with said first shoulder of said body so that said lid is engagable onto said upper end of said body; and a lateral portion of said nail scissors being enclosed and fenced by said lid so that nails cut by said nail scissors are prevented from discharging out of said lid and so that said nails can be directly collected in said body.

2. A protective casing according to claim 1, wherein a pair of ears are oppositely formed on said upper end of said body and extend upward, a pair of recesses are formed in a lower end of the lid and are engagable with said ears of said body so that said lid can further be retained on said upper end of said body.

3. A protective casing according to claim 1, wherein a first protrusion is formed on an upper end of an inner surface of a rear wall of the body, and a second protrusion is formed on an upper end of an inner surface of each side wall of said body, an upper portion of said nail scissors is received and retained among said first protrusion and said second protrusions.

* * * * *